US008777381B2

(12) United States Patent
Seki et al.

(10) Patent No.: US 8,777,381 B2
(45) Date of Patent: Jul. 15, 2014

(54) INKJET HEAD AND METHOD OF MANUFACTURING THE SAME

(71) Applicant: Toshiba Tec Kabushiki Kaisha, Tokyo (JP)

(72) Inventors: Masashi Seki, Sunto-gun (JP); Masashi Shimosato, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/154,250

(22) Filed: Jan. 14, 2014

(65) Prior Publication Data

US 2014/0125739 A1 May 8, 2014

Related U.S. Application Data

(62) Division of application No. 13/411,776, filed on Mar. 5, 2012, now Pat. No. 8,662,645.

(30) Foreign Application Priority Data

Mar. 16, 2011 (JP) ..... 2011-058378

(51) Int. Cl.
*B41J 2/045* (2006.01)

(52) U.S. Cl.
USPC ..... 347/69; 347/68; 347/71; 347/72; 347/45

(58) Field of Classification Search
USPC ..... 347/68–72, 45
See application file for complete search history.

(56) References Cited

U.S. PATENT DOCUMENTS

| | | | |
|---|---|---|---|
| 2010/0238237 | A1 | 9/2010 | Seki |
| 2010/0245475 | A1 | 9/2010 | Masashi et al. |
| 2012/0133709 | A1 | 5/2012 | Seki et al. |

FOREIGN PATENT DOCUMENTS

| | | |
|---|---|---|
| JP | 06-310866 | 11/1994 |
| JP | 2009-160903 | 7/2003 |
| JP | 05-318734 | 12/2003 |
| JP | 2006-245515 | 9/2006 |
| JP | 2007-110092 | 4/2007 |
| JP | 2008-149649 | 7/2008 |
| JP | 4182680 | 9/2008 |
| JP | 2009-196163 | 9/2009 |
| JP | 2009-233927 | 10/2009 |
| JP | 2011-029420 | 2/2011 |

OTHER PUBLICATIONS

U.S. Office Action mailed Jun. 20, 2013 corresponding to U.S. Appl. No. 13/411,776 filed on Mar. 5, 2012.
Japanese Office Action for Japanese Patent Application No. 2011-058378 mailed on Jul. 23, 2013.

*Primary Examiner* — Henok Legesse
(74) *Attorney, Agent, or Firm* — Amin, Turocy & Watson, LLP

(57) ABSTRACT

According to one embodiment, an inkjet head comprises a substrate, and a nozzle plate. The substrate includes grooves. The nozzle plate includes nozzles that are formed by laser processing to communicate with the grooves. Electrodes are formed on respective internal surfaces of the grooves. Each of the electrodes is formed of a plurality of metal layers, and includes a flat surface that is apart from the internal surfaces of the grooves. A first inorganic film is superposed on the surfaces of the electrodes. A second inorganic film is superposed on the first inorganic film.

7 Claims, 9 Drawing Sheets

INKJET HEAD AND METHOD OF MANUFACTURING THE SAME

CROSS-REFERENCE TO RELATED APPLICATIONS

This application is a Division of application Ser. No. 13/411,776 filed Mar. 5, 2012, the entire contents of which are incorporated herein by reference.

This application is based upon and claims the benefit of priority from the prior Japanese Patent Application No. 2011-058378, filed on Mar. 16, 2011, the entire contents of which are incorporated herein by reference.

FIELD

Embodiments described herein relate generally to an inkjet head, in which nozzles are formed in a nozzle plate by irradiating the nozzle plate adhered to a substrate with laser light, and a method of manufacturing the inkjet head.

BACKGROUND

Inkjet heads in which ink is ejected from a plurality of nozzles include a substrate which is formed of a piezoelectric material. The substrate is provided with a plurality of grooves to which ink is supplied. An electrode, to which a driving voltage is applied, is formed on an internal surface of each groove.

Each electrode is covered with a protective film which protects the electrode from ink. For example, an organic film such as polyparaxylene is used as the protective film. The probability that pin holes are generated in an organic film is smaller than the probability that pin holes are generated in an inorganic film. Therefore, even when various types of ink having electrical conductivity are used, it is possible to secure electric insulation of the electrode from ink.

According to inkjet heads of the prior art, the nozzles are formed in a nozzle plate by irradiating the nozzle plate adhered to the substrate with laser light. The laser light is made incident on the inside of the grooves directly after the laser light passes through the nozzle plate, and applied onto the protective film which covers the electrodes.

The organic film which forms the protective film disappears and a hole is generated when the organic film receives laser light, and thus a region of the organic film that receives laser light is damaged. As a result, the electrode is exposed through the hole which is opened in the organic film, and it is difficult to maintain electric insulation of the electrodes from ink. Therefore, in particular, in the case of using ink having electrical conductivity, it is inevitable that the electrodes are melted in an early stage. This reduces the durability of the inkjet head.

DETAILED DESCRIPTION

In general, according to one embodiment, an inkjet head comprises a substrate which is formed of a piezoelectric material, and a nozzle plate which is fixed onto the substrate by an adhesive. The substrate includes a plurality of grooves. The nozzle plate includes a plurality of nozzles that are formed by laser processing to communicate with the grooves. Electrodes, to which a driving voltage is applied, are formed on respective internal surfaces of the grooves. Each of the electrodes is formed of a plurality of metal layers that are superposed to cover the internal surfaces of the grooves, and includes a flat surface that is apart from the internal surfaces of the grooves. A first inorganic film is superposed on the surfaces of the electrodes. A second inorganic film is superposed on the first inorganic film. The second inorganic film is soaked in ink that is supplied to the grooves.

First Embodiment

A first embodiment will be explained hereinafter with reference to FIG. 1 to FIG. 16.

Figure 1:
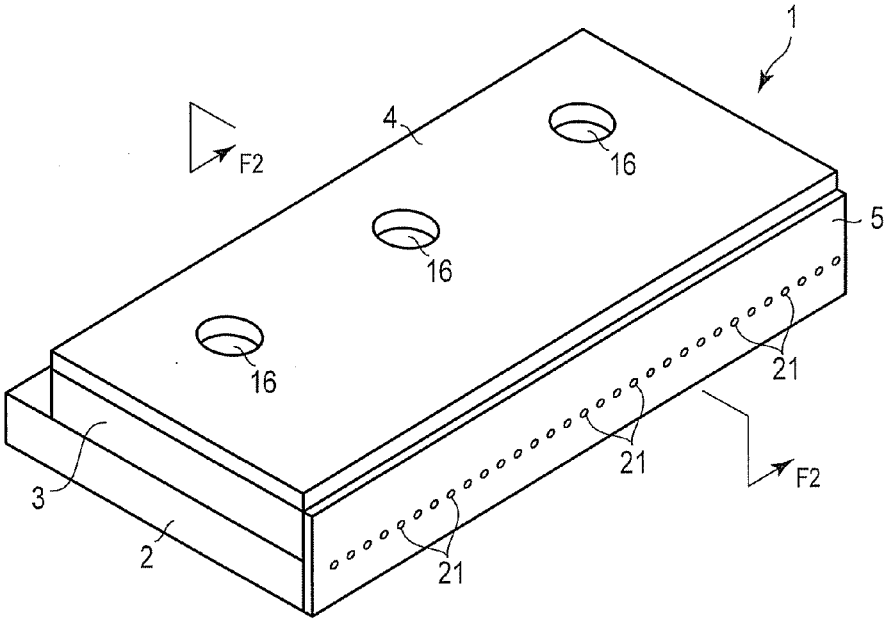
FIG. 1 is a perspective view of an inkjet head according to a first embodiment.
Figure 2:
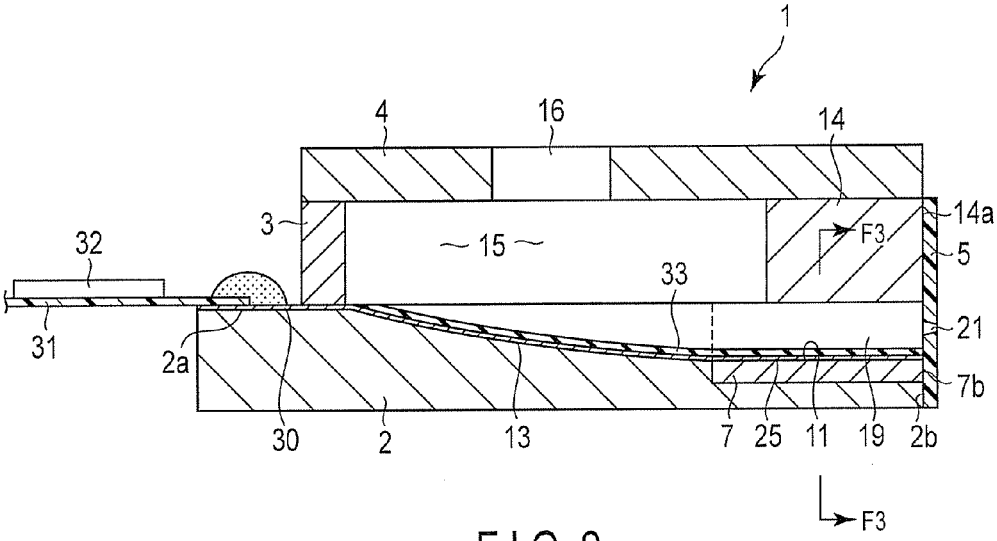
FIG. 2 is a cross-sectional view of the inkjet head, taken along line F2-F2 of FIG. 1.

FIG. 1 and FIG. 2 disclose a shear-mode inkjet head 1 which is used by being attached to, for example, a carriage of a printer. The inkjet head 1 comprises a substrate 2, a top-plate frame 3, a top plate 4, and a nozzle plate 5.

As the substrate 2, it is possible to use, for example, alumina ($Al_2O_3$), silicon nitride ($Si_3N_4$), silicon carbide (SiC), aluminum nitride (AlN), or lead zirconate titanate (PZT: $Pb(Zr,Ti)O_3$).

Figure 3:
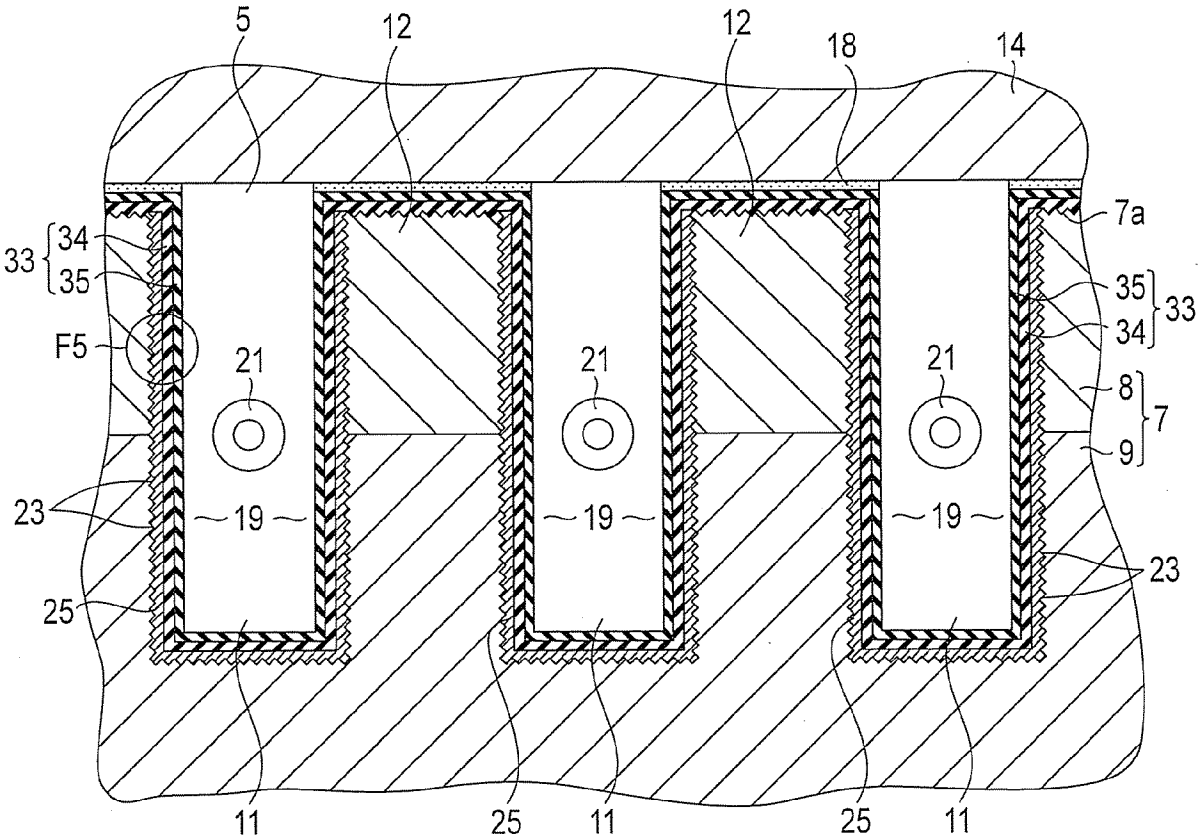
FIG. 3 is a cross-sectional view of the inkjet head, taken along line F3-F3 of FIG. 2.

As illustrated in FIG. 2, the substrate 2 has a rectangular shape which includes a front surface 2*a* and an end surface 2*b*. A piezoelectric element 7 which serves as an actuator is embedded in the front surface 2*a* of the substrate 2. As illustrated in FIG. 3, the piezoelectric element 7 includes two piezoelectric members 8 and 9. The piezoelectric members 8 and 9 are superposed on and adhered to each other, and extend in a longitudinal direction of the substrate 2. The piezoelectric element 7 includes a front surface 7*a* and an end surface 7*b*.

The front surface 7*a* of the piezoelectric element 7 is located on the same plane as the front surface 2*a* of the substrate 2, and exposed to the outside of the substrate 2. In the same manner, the end surface 7*b* of the piezoelectric element 7 is located on the same plane as the end surface 2*b* of the substrate 2, and exposed to the outside of the substrate 2. The piezoelectric members 8 and 9 are polarized in directions opposite to each other in a thickness direction of the piezoelectric members 8 and 9.

As the piezoelectric members 8 and 9, it is possible to use, for example, lead zirconate titanate (PZT), lithium niobate ($LiNbO_3$), or lithium tantalate ($LiTaO_3$). In the present embodiment, a high piezoelectric constant PZT is adopted as the piezoelectric members 8 and 9. In addition, a PZT with a dielectric constant lower than that of the piezoelectric members 8 and 9 is used as a material of the substrate 2, in consideration of the difference in the coefficient of expansion between the substrate 2 and the piezoelectric members 8 and 9 and the dielectric constants.

Figure 4:
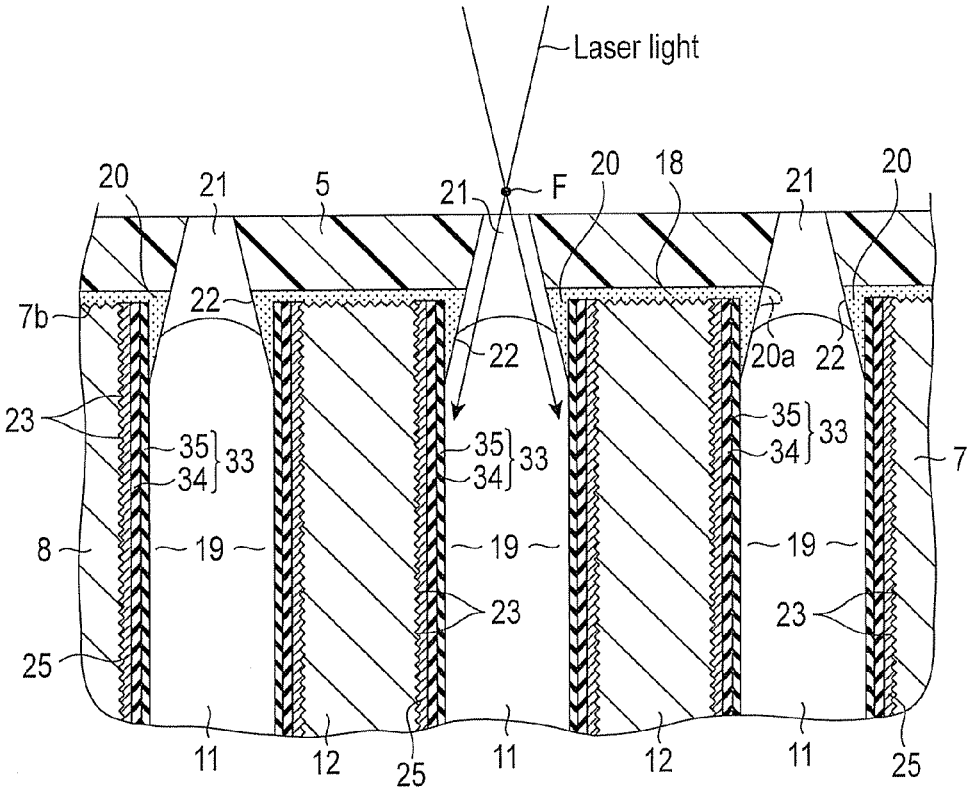
FIG. 4 is a cross-sectional view of the inkjet head according to the first embodiment.

As illustrated in FIG. 2 to FIG. 4, the piezoelectric element 7 is provided with a plurality of long grooves 11 and a plurality of partition walls 12. The long grooves 11 are opened to the front surface 7*a* and the end surface 7*b* of the piezoelectric element 7, and arranged in a line at intervals in a longitudinal direction of the piezoelectric element 7. According to the present embodiment, each long groove 11 has a depth of 300 μm, and a width of 80 μm. In addition, the long grooves 11 are arranged in parallel with each other at pitches of, for example, 169 μm.

As a result, in the substrate 2 of the present embodiment, an aspect ratio which is determined by a ratio (depth/width) of the depth to the width of the long grooves 11 is 3.75. Specifically, the aspect ratio increases when the depth of the long grooves 11 is increased and the width thereof is decreased. The aspect ratio and the intervals of the long grooves 11 are determined to desired values, according to the resolution and ink ejection amount required for the inkjet head 1.

In addition, each of the partition walls 12 of the piezoelectric element 7 is interposed between two adjacent long grooves 11, and separates the long grooves 11 from each other.

As illustrated in FIG. 2, each long groove 11 includes an extended part 13. The extended part 13 is extended from one end part of the long groove 11, which runs along the longitudinal direction of the long groove 11, toward the substrate 2. The extended part 13 is opened to the front surface 2*a* of the substrate 2, and has a depth which gradually decreases with increasing distance from the piezoelectric element 7. Therefore, a distal end of the extended part 13 of each long groove 11 is connected to the front surface 2*a* of the substrate 2.

The top-plate frame 3 is fixed onto the front surface 2*a* of the substrate 2 by means such as bonding. The top-plate frame 3 includes a front frame part 14. The front frame part 14 is superposed on the piezoelectric element 7, and extends along a direction in which the long grooves 11 are arranged. The front frame part 14 closes an opening end of each long groove 11, which is opened to the front surface 2*a* of the substrate 2. In addition, the front frame part 14 includes an end surface 14*a*. The end surface 14*a* is located on the same plane as the end surface 2*b* of the substrate 2 and the end surface 7*b* of the piezoelectric element 7.

The top plate 4 is superposed on the top-plate frame 3, and fixed onto the top-plate frame 3 by means such as bonding. A region which is enclosed by the top plate 4, the top-plate frame 3, and the front surface 2*a* of the substrate 2 forms a common pressure chamber 15. The top plate 4 includes a plurality of ink supply holes 16. The ink supply holes 16 supply ink to the common pressure chamber 15.

According to the present embodiment, the extended part 13 of each long groove 11 opened to the front surface 2*a* of the substrate 2 is exposed to the common pressure chamber 15. Therefore, each long groove 11 communicates with the common pressure chamber 15 through the extended part 13.

As illustrated in FIG. 1, FIG. 2, and FIG. 4, the nozzle plate 5 is adhered onto the end surface 2*b* of the substrate 2*b*, the end surface 7*b* of the piezoelectric element 7, and the end surface 14*a* of the front frame part 14 by an adhesive 18. The nozzle plate 5 is formed of, for example, a polyimide film. The polyimide film has a thickness of 50 μm. The nozzle plate 5 closes the opening ends of the long grooves 11, which are opened to the end surface 7*b* of the piezoelectric element 7.

Regions which are enclosed by internal surfaces of the respective long grooves 11, the front frame part 14 of the top-plate frame 3, and the nozzle plate 5 form a plurality of pressure chambers 19. The pressure chambers 19 are arranged in a line at intervals in the longitudinal direction of the piezoelectric member 7, and communicate with the common pressure chamber 15.

As illustrated in FIG. 2 and FIG. 3, the nozzle plate 5 includes a plurality of nozzles 21. The nozzles 21 are minute holes of a micron size, which pierce the nozzle plate 5 in a thickness direction of the nozzle plate 5. The nozzles 21 are formed by subjecting the nozzle plate 5 to laser processing using, for example, an excimer laser device. The nozzles 21 are arranged in a line at predetermined intervals to individually communicate with the pressure chambers 19, and opposed to a recording medium to be printed.

In the present embodiment, a position of focus F of laser light which is output from an excimer laser device is shifted to the outside of the nozzle plate 5, as illustrated in FIG. 4. Thereby, the laser light spreads toward each pressure chamber 19 when it pierces through the nozzle plate 5.

As a result, each of the nozzles 21 which are processed by laser light is formed to have a tapered shape, a diameter of which is gradually increased toward the pressure chamber 19. In each of the nozzles 21 of the present embodiment, a diameter of an upstream end which is opened to the pressure chamber 19 is 50 μm, and a diameter of an ejection end which is opened to a side opposite to the pressure chamber 19 is 30 μm.

As illustrated in FIG. 4, part of the adhesive 18 which fills the space between the end surface 7*b* of the piezoelectric member 7 and the nozzle plate 5 enters the pressure chambers 19 as surplus parts 20. The surplus parts 20 of the adhesive 18 are cured in a state of adhering onto a surface of the nozzle plate 5, which faces the pressure chambers 19, and being adjacent to the opening ends of the nozzles 21 in the pressure chambers 19.

In addition, cut parts 22 are formed in the surplus parts 20 of the adhesive 18. The cut parts 22 are parts which are left after the laser light to form the nozzles 21 passes through the surplus parts 22. The cut parts 22 are inclined to be aligned with internal surfaces of the nozzles 21. Specifically, as illustrated by two-dot chain lines in FIG. 4, for example, when an end part 20*a* of any surplus part 20 projects into the pressure chamber 19 at the opening end of the nozzle 21, the end part 20*a* is removed by laser light which pierces the nozzle plate 5. Therefore, the upstream end of the nozzle 21 is not partly covered with the adhesive 18.

The long grooves 11 which define the pressure chambers 19 are formed by subjecting the piezoelectric member 7 to cutting using, for example, a diamond cutter. Therefore, as illustrated in FIG. 3 and FIG. 4, each of internal surfaces of the long grooves 11 which define the pressure chambers 19 has a number of depressions and projections 23 of a micron size. In addition, the piezoelectric member 7 formed of PZT is fragile. Thereby, in the process of cutting the piezoelectric member 7, the internal surfaces of the long grooves 11 may be partly lacking. As a result, the internal surfaces of the long grooves 11 which have been subjected to cutting become rough surfaces which lack smoothness.

Figure 5:
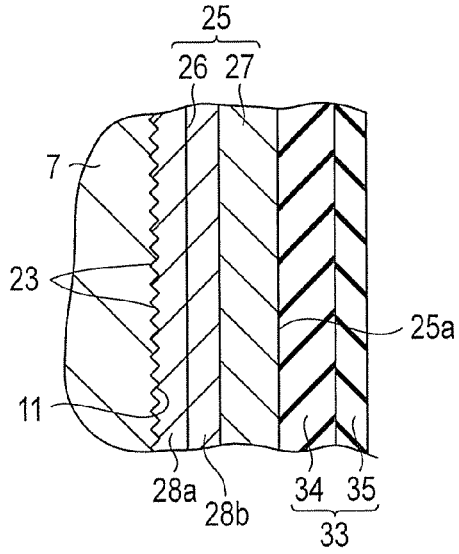
FIG. 5 is an enlarged cross-sectional view of a part of F5 illustrated in FIG. 3.

Electrodes 25 are formed on respective internal surfaces of the long grooves 11. Electrodes 25 of two adjacent long grooves 11 are separated from each other to be electrically independent of each other. As illustrated in FIG. 5, each electrode 25 is formed of a copper plating layer 26 and a nickel plating layer 27. The copper plating layer 26 is an example of a first metal layer. The nickel plating layer 27 is an example of a second metal layer. The copper plating layer 26 forms an undercoat of the electrode 25.

The copper plating layer 26 of the present embodiment has a two-layer structure including an electroless copper plating layer 28*a* and an electrolytic copper plating layer 28*b*. The electroless copper plating layer 28*a* is formed by subjecting the surface 2*a* of the substrate 2 and the internal surfaces of the long grooves 11 to electroless copper plating. The electroless copper plating layer 28*a* forms a predetermined electrode pattern for each long groove 11. The electrolytic copper plating layer 28*b* is formed by subjecting the surface 2*a* of the substrate 2 and the internal surfaces of the long grooves 11 to electrolytic copper plating. The electrolytic copper plating layer 28*b* is superposed on the electroless copper plating layer 28*a*.

The nickel plating layer 27 is formed by subjecting the copper plating layer 26 to electrolytic nickel plating. The nickel plating layer 27 is superposed on the copper plating layer 26 to cover the copper plating layer 26.

The copper plating layer 26 has a function of absorbing the depressions and projections 23 generated on the internal surfaces of the long grooves 11. Therefore, the nickel plating layer 27 which covers the copper plating layer 26 has a flat surface. Therefore, the surface 25*a* of each electrode 25 which is separated from the internal surface of each long groove 11 is flattened, and pointed projections are removed from the surface 25*a*. An average surface roughness of the surface 25*a* of each electrode 25 is preferably 0.6 μm or less.

As illustrated in FIG. 2, each electrode 25 includes a conductor pattern 30. The conductor pattern 30 is guided to the surface 2*a* of the substrate 2 through the common pressure chamber 15. The conductor pattern 30 is drawn out of the top-plate frame 3, and electrically connected to a tape carrier package 31. A driving circuit 32 which drives the inkjet head 1 is mounted onto the tape carrier package 31.

The driving circuit 32 applies a driving pulse (driving voltage) to the electrodes 25 of the inkjet head 1. Thereby, a difference in potential is generated between electrodes 25, which are adjacent to each other with the pressure chamber 19 interposed therebetween, and an electric field is generated in the partition walls 12 which correspond to the electrodes 25. As a result, the partition walls 12, which are adjacent to each other with the pressure chamber 19 interposed therebetween, shear and are curved to increase the volume of the pressure chamber 19.

When the polarity of the driving pulse applied to the electrodes 25 is reversed, the partition walls 12 return to their initial shapes. By returning the partition walls 12 to their initial shapes, ink which is supplied from the common pressure chamber 15 to the pressure chamber 19 is pressurized. Part of the pressurized ink is changed to ink drops and ejected from the nozzles 21 toward the recording medium.

As illustrated in FIG. 3 to FIG. 5, each electrode 25 is covered with an electrode protective layer 33. The electrode protective layer 33 has a two-layer structure including an insulating film 34 and a protective film 35. The insulating film 34 is an example of a first inorganic film. The insulating film 34 is formed of an inorganic insulating material such as silicon dioxide ($SiO_2$). The insulating film 34 is superposed on the flat surface 25*a* of the electrode 25. The insulating film 34 preferably has a thickness of 1.0 μm or more.

The protective film 35 is an example of a second inorganic film. The protective film 35 is formed of an inorganic insulating material such as hafnium oxide ($HfO_2$). The protective film 35 is superposed on a surface of the insulating film 34, and covers the insulating film 34. Therefore, the protective film 35 is exposed to the inside of each pressure chamber 19, to be soaked in ink supplied to the pressure chamber 19. The protective film 35 preferably has a thickness of 50 nm or more.

According to the inkjet head 1 of the first embodiment, laser light which forms the nozzles 21 pierces the nozzle plate 5 and is made incident on each pressure chamber 19, as illustrated in FIG. 4. Since the laser light spreads from the nozzle plate 5 toward the pressure chamber 19, part of the laser light is applied onto the protective film 35 which covers the electrode 25.

The protective film 35 and the insulating film 34 which are formed of inorganic insulating materials are difficult to be damaged by irradiation of laser light. Therefore, each electrode 25 is maintained in a state of being electrically insulated from ink supplied to the pressure chamber 19. Therefore, even when the ink has electrical conductivity, it is possible to prevent corrosion of the electrodes 25 and electric decomposition of ink due to flow of a current through the ink.

On the other hand, the insulating film 34 and the protective film 35 which are formed of inorganic insulating materials are easily influenced by surface roughness of the electrodes 25. Specifically, when the surface roughness of the electrodes 25 increases, pin holes may be generated in the insulating film 34 and the protective film 35.

In the first embodiment, the undercoat of the electrodes 25 is formed of the copper plating layer 26. The copper plating layer 26 has a function of absorbing the many depressions and projections 23 of a micron size, which are generated on the internal surfaces of the long grooves 11, and smoothing the internal surfaces of the long grooves 11. Therefore, the surface 25*a* of each electrode 25 is a flat surface, from which pointed projections that cause pin holes are removed. Therefore, pin holes are hardly generated in the insulating film 34 and the protective film 35 which are superposed on the surface 25*a* of each electrode 25.

In addition, even when pin holes are generated in the insulating film 34 deposited on the surface 25*a* of the electrode 25, the pin holes of the insulating film 34 can be covered with the protective film 35 deposited on the insulating film 34.

Consequently, even in the structure of forming the nozzles 21 by irradiating the nozzle plate 5 adhered onto the substrate 2 with laser light, it is possible to maintain electrical insulation of the electrodes 25 from ink, and avoid corrosion of the electrodes 25 and electrical decomposition of ink. Therefore, it is possible to obtain the inkjet head 1 which has a good printing quality and excellent durability.

The inventor(s) of the present embodiment performed the following experiment, using the inkjet head 1 in which an average surface roughness of the surfaces 25*a* of the electrodes 25 was 0.6 μm or less. In the experiment, several types of inorganic insulating materials which formed the insulating film 34 were prepared, and whether the insulating film 34 included any pin holes when the thickness of each inorganic insulating material was changed within a range of 1.0 μm to 5.0 μm was checked.

As a result, no pin holes were recognized, as long as the thickness of the insulating film 34 fell within the range of 1.0 μm to 5.0 μm. Therefore, to eliminate pin holes from the insulating film 34, it is desired to set the thickness of the insulating film 34 formed of an inorganic insulating material to 1.0 μm or more. More preferably, the insulating film 34 has a thickness of 3 μm or more.

Next, a process of manufacturing the inkjet head 1 of the first embodiment will be explained, with reference to FIG. 6 to FIG. 16.

Figure 6:
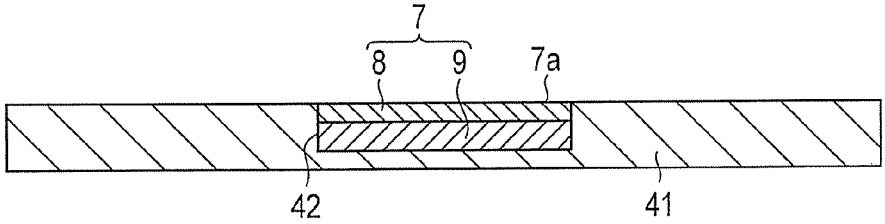
FIG. 6 is a cross-sectional view of a state in which a piezoelectric element is embedded in a substrate structure in the first embodiment.

First, two piezoelectric members 8 and 9 are adhered to each other, and thereby a piezoelectric element 7 which has reversed polarizing directions is formed. Thereafter, a substrate structure 41 as illustrated in FIG. 6 is prepared. The substrate structure 41 has a size twice as large as the substrate 2, and a depressed part 42 is formed in a center part of a surface of the substrate structure 41. PZT, which has a dielectric constant lower than that of the piezoelectric element 7, is used as the substrate structure 41. Then, the piezoelectric element 7 is embedded in and adhered to the depressed part 42 of the substrate structure 41.

Figure 8:
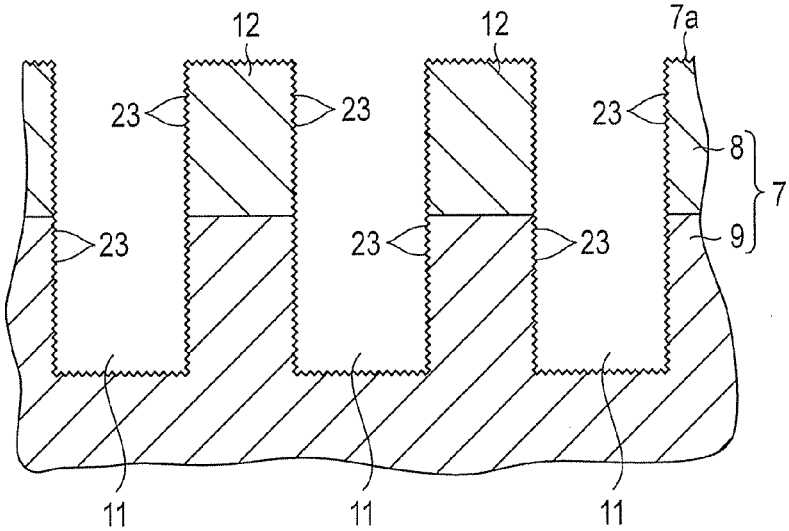
FIG. 8 is a cross-sectional view illustrating a state where the long grooves are formed in the piezoelectric element in the first embodiment.
Figure 9:
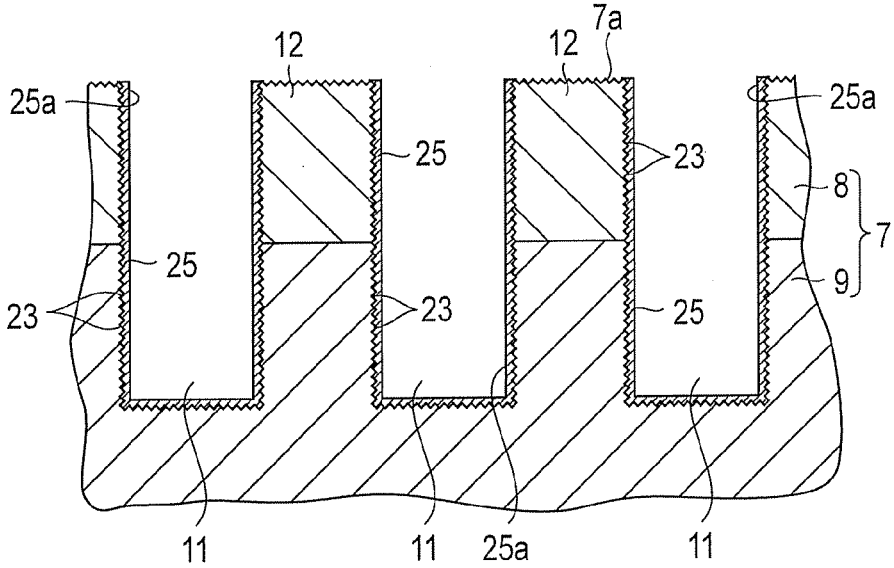
FIG. 9 is a cross-sectional view of a state in which an electrode is formed on an internal surface of each of the long grooves in the first embodiment.

Thereafter, the piezoelectric element 7 is subjected to cutting by using a disk-shaped diamond cutter, and thereby a plurality of long grooves 11 as illustrated in FIG. 8 and FIG. 9 are formed in the piezoelectric element 7. In the present embodiment, a diamond cutter which has a face width of 80 μm is used as the diamond cutter. Therefore, the width of each long groove 11 is 80 μm. The depth of each long groove 11 is determined by a moving quantity of the diamond cutter along a thickness direction of the piezoelectric element 7. In the present embodiment, the depth of each long groove 11 is 300 μm. The internal surface of each long groove 11 is a rough surface which includes many depressions and projections 23.

Figure 7:
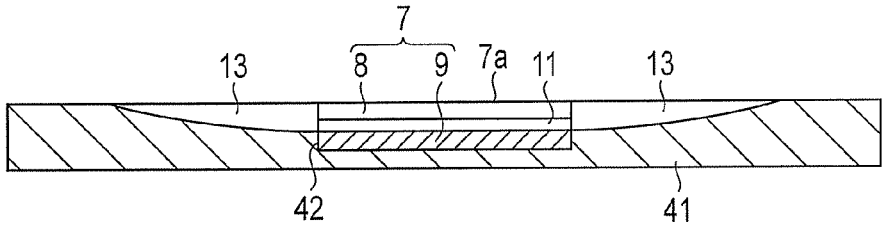
FIG. 7 is a cross-sectional view of a state in which a plurality of long grooves are formed in the substrate structure and the piezoelectric element in the first embodiment.

As illustrated in FIG. 7, when the long grooves 11 are formed in the piezoelectric element 7, the surface of the substrate structure 41 is scraped off in a shape of grooves by the diamond cutter. Parts of the substrate structure 41 which are scraped off by the diamond cutter function as extended parts 13, each of which has a gradually decreasing depth.

Thereafter, an electroless copper plating layer 28*a* is formed on the internal surfaces of the long grooves 11 including the extended parts 13 and the surface of the substrate structure 41. Thereafter, an electrolytic copper plating layer 28*b* is formed on the electroless copper plating layer 28*a*. Thereby, a copper plating layer 26 serving as an undercoat is formed on the internal surfaces of the long grooves 11.

In addition, a nickel plating layer 27 is formed on the electrolytic copper plating layer 28*b* serving as a surface layer of the copper plating layer 26. Thereby, an electrode 25 having a two-layer structure and a conductor pattern 30 are formed on the internal surface of each long groove 11.

The copper plating layer 26 levels the internal surface of each long groove 11 having many depressions and projections 23. As a result, the nickel plating layer 27 which covers the copper plating layer 26 has a flat surface. Therefore, the surfaces 25*a* of the electrodes 25 which are apart from the internal surfaces of the long grooves 11 are flattened, and an average surface roughness of the surfaces 25*a* of the electrodes 25 is 0.6 μm or less.

Thereafter, parts of each electrode 25, which are formed on upper surfaces of the partition walls 12 that partition adjacent long grooves 11, are removed from the upper surfaces of the partition walls 12 by means such as grinding.

Figure 10:
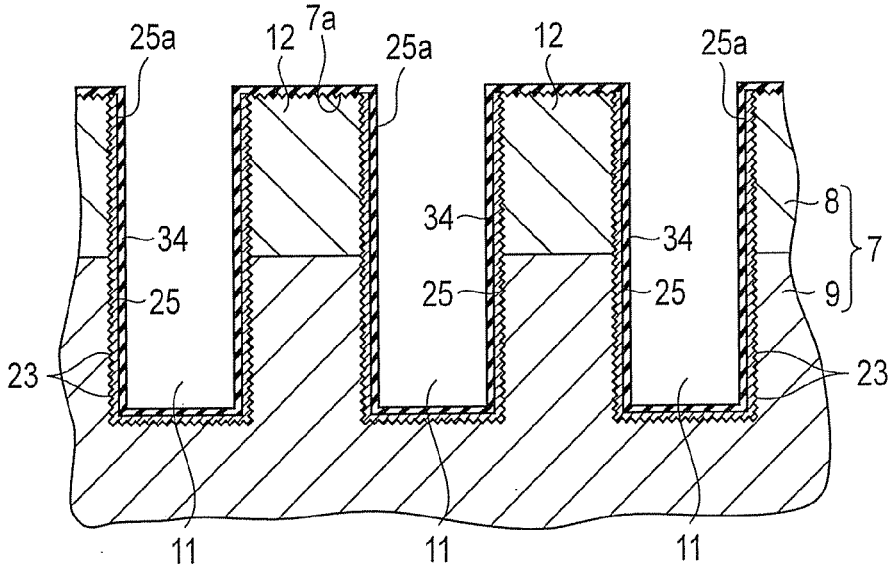
FIG. 10 is a cross-sectional view of a state where surfaces of the electrodes are covered with an insulating film in the first embodiment.

Next, as illustrated in FIG. 10, an insulating film 34 is formed on the electrodes 25 in the long grooves 11. Silicon dioxide, which is an example of an inorganic insulating material, is used as the insulating film 34. The insulating film 34 is formed by, for example, PE-CVD (Plasma-Enhanced Chemical Vapor Deposition). The insulating film 34 has a thickness of 1.0 μm or more. The inorganic insulating material which forms the insulating film 34 is not limited to silicon dioxide. As the inorganic insulating material, for example, it is possible to use $Al_2O_3$, SiN, ZnO, MgO, $ZrO_2$, $Ta_2O_5$, $Cr_2O_3$, $TiO_2$, $Y_2O_3$, YBCO, mullite ($Al_2O_3.SiO_2$), $SrTiO_3$, $Si_3N_4$, ZrN, AlN, or $Fe_3O_4$.

As the method of forming the insulating film 34, it is possible to use, for example, MBE (Molecular Beam Epitaxy), AP-CVD (Atmospheric-Pressure Chemical Vapor Deposition), ALD (Atomic-Layer Deposition), or application, as well as PE-CVD. In other words, the method of forming the insulating film 34 is not limited, as long as the inorganic insulating material can be deposited on the nickel plating layer 27 by reacting or condensing the inorganic insulating material including $SiO_2$ on the nickel plating layer 27 in a vacuum or the atmosphere.

When the insulating film 34 is formed, part of the conductor pattern 30 which is guided to the surface of the substrate structure 41 is masked. Thereby, the insulating film 34 is prevented from being formed on part of the conductor pattern 30, to which the tape carrier package 31 is connected.

Figure 11:
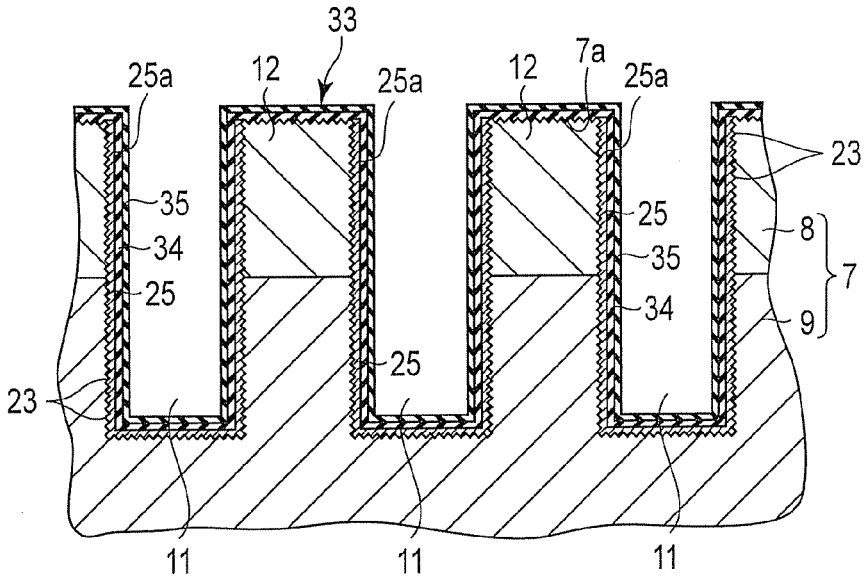
FIG. 11 is a cross-sectional view of a state where a protective film is superposed on the insulating film in the first embodiment.
Figure 12:
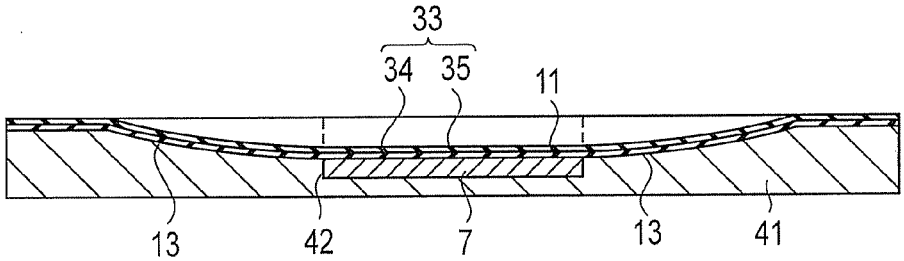
FIG. 12 is a cross-sectional view of a state where an electrode protective layer is formed on a surface of the substrate structure and internal surfaces of the long grooves in the first embodiment.

Then, as illustrated in FIG. 11 and FIG. 12, a protective film 35 is formed on the insulating film 34. Hafnium oxide ($HfO_2$), which is an example of the inorganic insulating material, is used as the protective film 35. The protective film 35 is formed by, for example, ALD (Atomic-Layer Deposition). The protective film 35 has a thickness of 50 nm or more. The inorganic insulating material which forms the protective film 35 is not limited to hafnium oxide, but may be, for example, $Al_2O_3$, or $SiO_2$.

As the method of forming the protective film 35, it is possible to use AP-CVD (Atmospheric-Pressure Chemical Vapor Deposition), as well as ALD. In other words, the method of forming the protective film 35 is not limited, as long as the inorganic insulating material can be deposited on the insulating film 34 by reacting or condensing the inorganic insulating material including hafnium oxide on the insulating film 34 in a vacuum or the atmosphere.

In addition, when the protective film 35 is formed, part of the conductor pattern 30 which is guided to the surface of the substrate structure 41 is masked. Thereby, the protective film 35 is prevented from being formed on the part of the conductor pattern 30 to which the tape carrier package 31 is connected.

Figure 13:
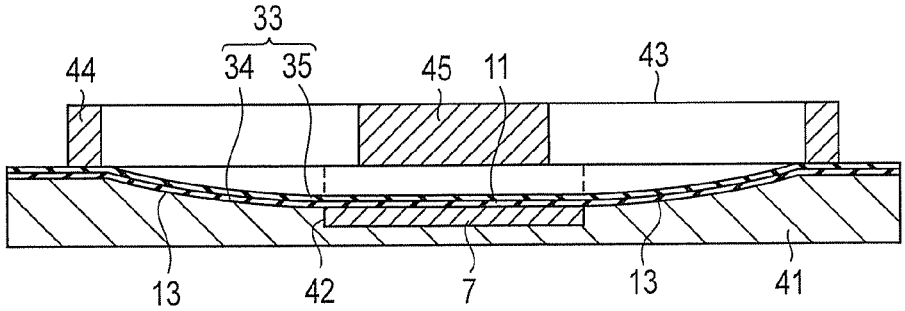
FIG. 13 is a cross-sectional view of a state where a top-plate frame structure is adhered to the substrate structure.

Thereafter, as illustrated in FIG. 13, a top-plate frame structure 43 is fixed on a surface of the substrate structure 41 by means such as bonding. The top-plate structure 43 includes a frame part 44 and a center part 45. The frame part 44 is superposed on an outer peripheral part of the surface of the substrate structure 41. The center part 45 is surrounded by the frame part 44, and superposed on the piezoelectric element 7 in which the long grooves 11 are formed. Therefore, the center part 45 closes the opening end of each long groove 11.

Figure 14:
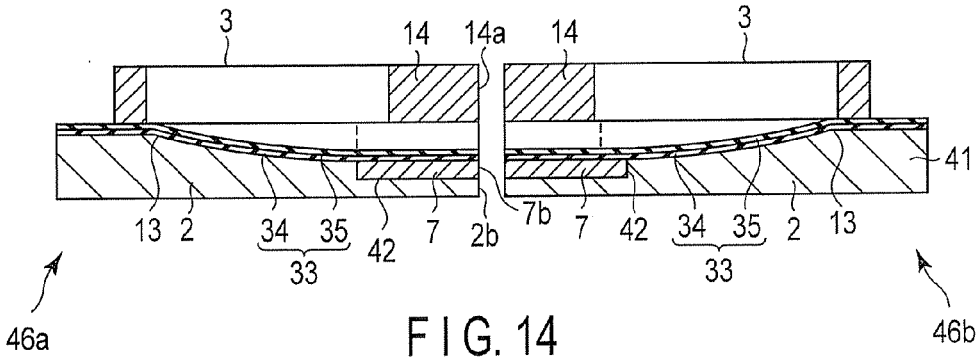
FIG. 14 is a cross-sectional view of a state where the substrate structure, to which the top-plate frame structure is adhered, is divided into two head blocks in the first embodiment.

Thereafter, as illustrated in FIG. 14, the substrate structure 41, to which the top-plate frame structure 43 is adhered, is subjected to cutting using a diamond cutter or the like. Thereby, the substrate structure 41 is divided into two together with the top-plate frame structure 43. As a result, a pair of head blocks 46*a* and 46*b*, in each of which the substrate 2 is united with the top-plate frame 3, are formed. In each of the head blocks 46*a* and 46*b*, the end surface 2*b* of the substrate 2, the end surface 7*b* of the piezoelectric element 7, and the end surface 14*a* of the front frame part 14 of the top-plate frame 3 are located at a divided end of each of the head blocks 46*a* and 46*b*, and located on the same plane.

Figure 15:
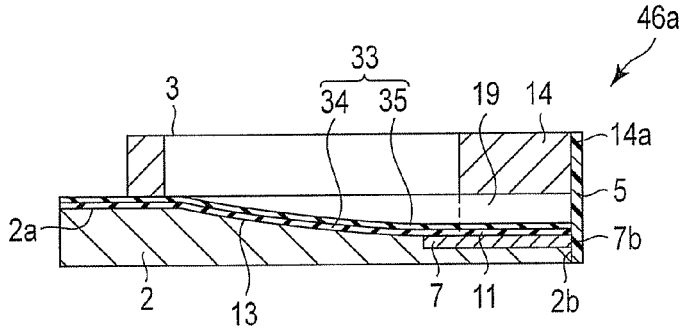
FIG. 15 is a cross-sectional view of a state where a nozzle plate before formation of nozzles is adhered to a head block in the first embodiment.

Thereafter, as illustrated in FIG. 15 which shows one head block 46*a* as a representative, a nozzle plate 5 before formation of nozzles is adhered to spread over the end surface 2*b* of the substrate 2, the end surface 7*b* of the piezoelectric element 7, and the end surface 14*a* of the front frame part 14 of the top-plate frame 3. As a result, a plurality of pressure chambers 19 are formed between the respective long grooves 11 of the substrate 2 and the front frame part 14 of the top-plate frame 3.

Surplus parts 20 of adhesive 18 which fills the space between the end surface 7*b* of the piezoelectric element 7 and the nozzle plate 5 enter the pressure chambers 19. The surplus parts 20 of the adhesive 18 are left as a thin film on a surface of the nozzle plate 5 which faces the pressure chambers 19.

Figure 16:
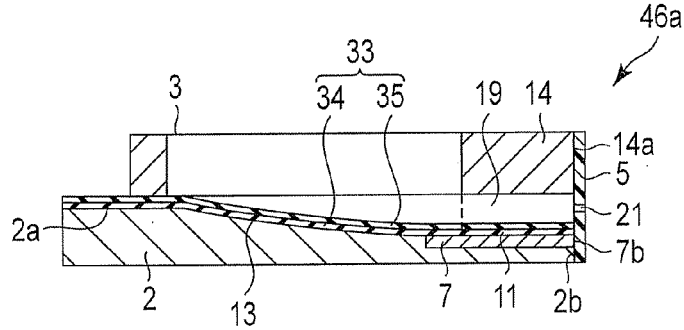
FIG. 16 is a cross-sectional view of a state where nozzles are formed in the nozzle plate adhered to the head block by using laser light in the first embodiment.

Thereafter, as illustrated in FIG. 4 and FIG. 16, the nozzle plate 5 is subjected to laser processing using, for example, an excimer laser device, and thereby a plurality of nozzles 21 are formed in the nozzle plate 5. Specifically, the nozzle plate 5 is irradiated with laser light from a side opposite to the pressure chambers 19. Thereby, parts of the nozzle plate 5 formed of a polyimide film, which are irradiated with the laser light, are chemically decomposed and changed to the nozzles 21.

As illustrated in FIG. 4, the focus F of the laser light is located outside the nozzle plate 5. Therefore, the laser light spreads in a flare shape toward each pressure chamber 19. Therefore, each nozzle 21 has a tapered shape, with a diameter continuously increasing toward the corresponding pressure chamber 19.

The laser light pierces the nozzle plate 5 in a thickness direction, and thereafter is made incident on each pressure chamber 19. The protective film 35 which is exposed to the inside of each pressure chamber 19 is irradiated with the laser light in the vicinity of the nozzle 21.

The protective film 35 which is formed of an inorganic insulating material is difficult to be damaged by irradiation of laser light. Therefore, no holes are generated in a region of the protective film 35 irradiated with laser light.

The end part 20*a* of each surplus part 20 of the adhesive 18 may project to a region in which a nozzle 21 is to be formed in the pressure chamber 19, before the nozzles 21 are formed in the nozzle plate 5. The end part 20*a* of each surplus part 20 is removed by laser light, when the laser light pierces the nozzle plate 5 and is made incident on the pressure chamber 19.

Consequently, the surplus parts 20 of the adhesive 18 do not close the nozzles 21. Therefore, the surplus parts 20 of the adhesive 18 do not affect the flow of ink which is ejected from the nozzles 21, and it is possible to maintain a good printing quality.

Second Embodiment

Figure 17:
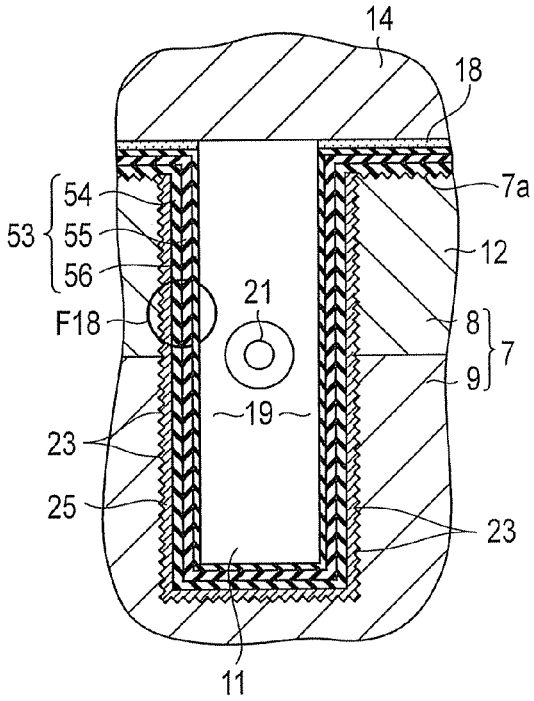
FIG. 17 is a cross-sectional view of an inkjet head according to a second embodiment.
Figure 18:
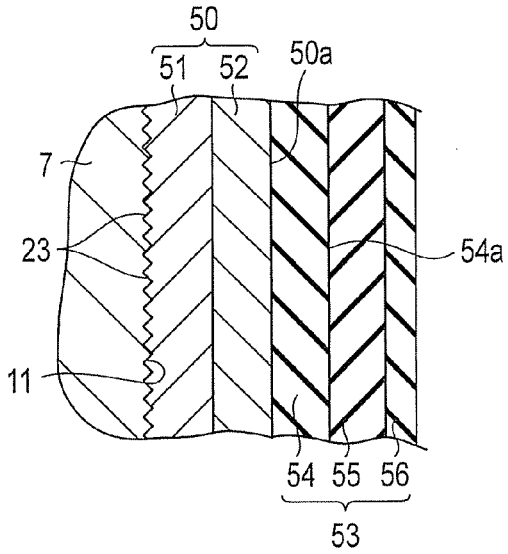
FIG. 18 is an enlarged cross-sectional view of a part of F18 illustrated in FIG. 17.

FIG. 17 and FIG. 18 disclose a second embodiment.

The second embodiment is different from the first embodiment in a structure of the electrodes and the electrode protective layer. The structure of the other parts of the inkjet head of the second embodiment is the same as the first embodiment. Therefore, in the second embodiment, constituent elements which are the same as those of the first embodiment are denoted by the same respective reference numerals as those of the first embodiment, and explanation thereof is omitted.

As illustrated in FIG. 18, each electrode 50 is formed of a nickel plating layer 51 and a gold plating layer 52. The nickel plating layer 51 is an example of the first metal layer. The gold plating layer 52 is an example of the second metal layer. The nickel plating layer 51 forms an undercoat of the electrode 50.

The nickel plating layer 51 is superposed on an internal surface of each long groove 11, and forms a predetermined electrode pattern for each long groove 11. The gold plating layer 52 is superposed on the nickel plating layer 51, and covers the nickel plating layer 51.

The nickel plating layer 51 and the gold plating layer 52 are inferior to the copper plating layer 26 of the first embodiment, in the function of flattening the internal surface of each long groove 11. In other words, a surface 50*a* of each electrode 50 is not smooth due to the influence of depressions and projections 23 which are generated on the internal surface of the long groove 11.

Each electrode 50 is covered with an electrode protective layer 53. The electrode protective layer 53 has a three-layer structure including a smoothing film 54, an insulating film 55, and a protective film 56. The smoothing film 54 is an example of a first inorganic film. The smoothing film 54 is formed of an inorganic insulating material such as Siragusital. The smoothing film 54 has a thickness with which the smoothing film 54 can absorb the depressions and projections generated on the surface 50*a* of each electrode 50.

Therefore, a surface 54*a* of the smoothing film 54 which is apart from the electrode 50 is flattened, and pointed projections are removed from the surface 54*a*. The surface 54*a* of the smoothing film 54 preferably has an average surface roughness of 0.6 μm or less.

The insulating film 55 is an example of a second inorganic film. The insulating film 55 is formed of an inorganic insulating material such as silicon dioxide ($SiO_2$). The insulating film 55 is superposed on the surface 54*a* of the smoothing film 54. The insulating film 55 preferably has a thickness of 1.0 μm or more.

The protective film 56 is an example of a third inorganic film. The protective film 56 is formed of an inorganic insulating material such as hafnium oxide ($HfO_2$). The protective film 56 is superposed on a surface of the insulating film 55, and covers the insulating film 55. Therefore, the protective film 56 is exposed to the inside of each pressure chamber 19, and soaked in ink which is supplied to each pressure chamber 19. The protective film 56 preferably has a thickness of 50 nm or more.

The second embodiment is different from the first embodiment in the process of forming the electrodes 50 and the electrode protective layer 53. The other parts of the process of manufacturing the inkjet head 1 are the same as those of the first embodiment. Therefore, in the second embodiment, only the process of forming the electrodes 50 and the electrode protective layer 53 is explained.

After long grooves 11 are formed in a piezoelectric element 7, a nickel plating layer 51 is formed. The nickel plating layer 51 is obtained by subjecting internal surfaces of the long grooves 11 and a surface of a substrate structure 41 to electroless nickel plating. Then, a gold plating layer 52 is formed on the nickel plating layer 51. The gold plating layer 52 is obtained by subjecting the nickel plating layer 51 to electrolytic gold plating. Thereby, an electrode 50 which has a two-layer structure as illustrated in FIG. 18 is formed on the internal surface of each long groove 11.

Thereafter, parts of the electrodes 50 which are formed on upper surfaces of partition walls 12 that partition adjacent long grooves 11 are removed from the upper surfaces of the partition walls 12 by means such as grinding.

Then, a smoothing film 54 is formed on the electrodes 50 of the long grooves 11. Siragusital, which is an example of the inorganic insulating material, is used as the smoothing film 54. The smoothing film 54 is obtained by applying Siragusital in a liquid phase to the surfaces 50*a* of the electrodes 50 and thereafter curing the Siragusital at normal temperature.

Specifically, the smoothing film 54 is applied to the surfaces 50*a* of the electrodes 50, with a thickness to set an average surface roughness of the surface 54*a* which is apart from the electrodes 50 to 0.6 μm or less. The thickness of the smoothing film 54 differs according to the type of the inorganic insulating material used.

By virtue of the existence of the smoothing film 54 having the above structure, the depressions and projections generated on the surface 50*a* of each electrode 50 are absorbed, and the surface 54*a* of the smoothing film 54 is flattened.

As the material which forms the smoothing film 54, it is possible to use a liquid which is obtained by dissolving, for example, nanosilica in an organic solvent. The method of forming the smoothing film 54 is not limited to application, but may be, for example, a Sol-Gel process, Spray process, or electrodeposition process. In other words, the method of forming the smoothing film 54 is not limited, as long as the liquid can be adhered to the electrodes 50 that are formed inside the long grooves 11 and the liquid can be cured.

Thereafter, an insulating film 55 is formed on the smoothing film 54. Silicon dioxide, which is an example of the inorganic insulating material, is used as the insulating film 55. The insulating film 55 is formed by, for example, PE-CVD (Plasma-Enhanced Chemical Vapor Deposition). The insulating film 55 has a thickness of 1.0 μm or more.

The inorganic insulating material which forms the insulating film 55 is not limited to silicon dioxide. As the inorganic insulating material, it is possible to use, for example, $Al_2O_3$, SiN, ZnO, MgO, $ZrO_2$, $Ta_2O_5$, $Cr_2O_3$, $TiO_2$, $Y_2O_3$, YBCO, mullite ($Al_2O_3.SiO_2$), $SrTiO_3$, $Si_3N_4$, ZrN, AlN, or $Fe_3O_4$.

As the method of forming the insulating film 55, it is possible to use, for example, MBE (Molecular Beam Epitaxy), AP-CVD (Atmospheric-Pressure Chemical Vapor Deposition), ALD (Atomic-Layer Deposition), or application, as well as PE-CVD. In other words, the method of forming the insulating film 55 is not limited, as long as the inorganic insulating material can be deposited on the smoothing film 54 by reacting or condensing the inorganic insulating material including $SiO_2$ on the smoothing film 54 in a vacuum or the atmosphere.

When the insulating film 55 is formed, part of the conductor pattern 30 which is guided to the surface of the substrate structure 41 is masked. Thereby, the insulating film 55 is prevented from being formed on the part of the conductor pattern 30 to which a tape carrier package 31 is connected.

Then, a protective film 56 is formed on the insulating film 55. Hafnium oxide ($HfO_2$), which is an example of the inorganic insulating material, is used as the protective film 56. The protective film 56 is formed by, for example, ALD (Atomic-Layer Deposition). The protective film 56 has a thickness of 50 nm or more.

The inorganic insulating material which forms the protective film 56 is not limited to hafnium oxide, but may be, for example, $Al_2O_3$, or $SiO_2$.

As the method of forming the protective film 56, it is possible to use AP-CVD (Atmospheric-Pressure Chemical Vapor Deposition) or the like, as well as ALD. In other words, the method of forming the protective film 56 is not limited, as long as the inorganic insulating material can be deposited on the insulating film 55 by reacting or condensing the inorganic insulating material including hafnium oxide on the insulating film 55 in a vacuum or the atmosphere.

In addition, when the protective film 56 is formed, part of the conductor pattern 30 which is guided to the surface of the substrate structure 41 is masked. Thereby, the protective film 56 is prevented from being formed on the part of the conductor pattern 30 to which the tape carrier package 31 is connected.

According to the second embodiment, the smoothing film 54 which is applied to the surface 50*a* of each electrode 50 absorbs many depressions and projections generated on the surface 50*a* of each electrode 50. Therefore, the surface 54*a* of the smoothing film 54 which is apart from each electrode 50 is a flat surface, from which pointed projections that cause pin holes are removed. Therefore, pin holes are hardly generated in the insulating film 55 and the protective film 56.

In addition, even when pin holes are generated in the insulating film 55, the protective film 56 superposed on the insulating film 55 can cover the pin holes generated in the insulating film 55. Consequently, it is possible to maintain electrical insulation of the electrodes 50 from ink by using the electrode protective layer 53 having the three-layer structure, and avoid corrosion of the electrodes 50 and electrical decomposition of ink. Therefore, it is possible to obtain the inkjet head 1 with good printing quality and excellent durability, in the same manner as the first embodiment.

Third Embodiment

Figure 19:
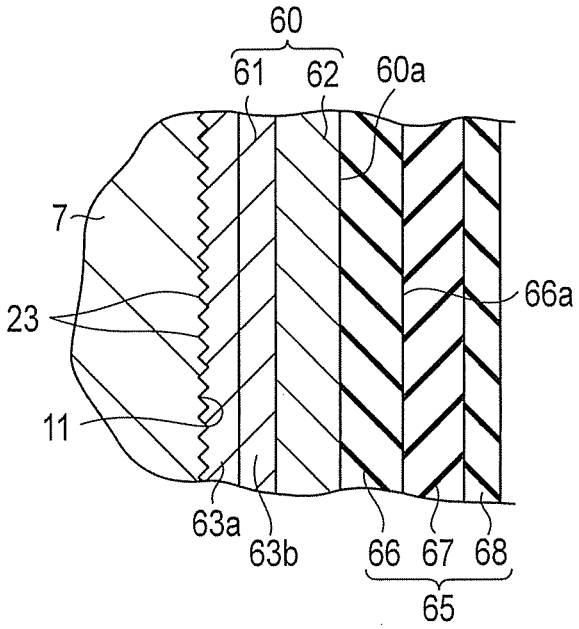
FIG. 19 is a cross-sectional view of a third embodiment, illustrating a positional relation between an electrode, a smoothing film, an insulating film, and a protective film.

FIG. 19 discloses a third embodiment.

The third embodiment is obtained by combining the electrodes of the first embodiment with the electrode protective layer of the second embodiment. An inkjet head of the third embodiment has the same basic structure as that of the first embodiment. Therefore, in the third embodiment, constituent elements which are the same as those of the first embodiment are denoted by the same respective reference numerals as those of the first embodiment, and explanation thereof is omitted.

As illustrated in FIG. 19, each of electrodes 60 which cover respective internal surfaces of long grooves 11 is formed of a copper plating layer 61 serving as a first metal layer, and a nickel plating layer 62 serving as a second metal layer. The copper plating layer 61 is an element which forms an undercoat of the electrodes 60.

The copper plating layer 61 has a two-layer structure including an electroless copper plating layer 63*a* and an electrolytic copper plating layer 63*b*.

The electroless copper plating layer 63*a* is superposed on an internal surface of each long groove 11, and forms a predetermined electrode pattern for each long groove 11. The electrolytic copper plating layer 63*b* is superposed on the electroless copper plating layer 63*a*, and covers the electroless copper plating layer 63*a*. The nickel plating layer 62 is superposed on the copper plating layer 61, and covers the copper plating layer 61.

The copper plating layer 61 has a function of absorbing many depressions and projections 23 generated on the internal surface of each long groove 11. Therefore, by virtue of existence of the copper plating layer 61, the nickel plating layer 62 which covers the copper plating layer 61 has a flat surface.

Therefore, a surface 60*a* of each electrode 60 which is apart from the internal surface of the long groove 11 is flattened, and pointed projections are removed from the surface 60*a*. The surface 60*a* of each electrode 60 has an average surface roughness of 0.6 μm or less.

The electrodes 60 are covered with an electrode protective layer 65. The electrode protective layer 65 has a three-layer structure including a smoothing film 66, an insulating film 67, and a protective film 68. The smoothing film 66 is formed of an inorganic insulating material such as Siragusital. The smoothing film 66 has a thickness such that depressions and projections generated on the surface 60*a* of each electrode 60 can be absorbed. Therefore, a surface 66*a* of the smoothing film 66 which is apart from each electrode 60 is flattened, and pointed projections are removed from the surface 66*a*. The surface 66*a* of the smoothing film 66 preferably has an average surface roughness of 0.6 μm or less.

The insulating film 67 is formed of an inorganic insulating material such as silicon dioxide ($SiO_2$). The insulating film 67 is superposed on the surface 66*a* of the smoothing film 66. The insulating film 67 preferably has a thickness of 1.0 μm or more.

The protective film 68 is formed of an inorganic material such as hafnium oxide ($HfO_2$). The protective film 68 is superposed on a surface of the insulating film 67, and covers the insulating film 67. The protective film 68 is exposed to the inside of each pressure chamber 19, and soaked in ink which is supplied to the pressure chambers 19. The protective film 68 preferably has a thickness of 50 nm or more.

The third embodiment is different from the first embodiment in the process of forming an electrode protective layer 65 on the surfaces 60*a* of the electrodes 60. The other parts of the process of manufacturing the inkjet head 1 are the same as those of the first embodiment. Therefore, in the third embodiment, only the process of forming the electrode protective layer 65 is explained.

A smoothing film 66 is formed on electrodes 60 which are formed on the internal surfaces of the long grooves 11. In the present embodiment, for example, a Siragusital solution is adhered onto the surfaces 60*a* of the electrodes 60 by dipping, and thereby the smoothing film 66 is formed on the surfaces 60*a* of the electrodes 60. The smoothing film 66 is formed on the surface 60*a* of each electrode 60, with a thickness such that the surface 66*a* apart from the electrodes 60 has an average surface roughness of 0.6 μm or less.

By virtue of the existence of the smoothing film 66 having the above structure, many depressions and projections generated on the surface 60*a* of each electrode 60 are absorbed, and the surface 66*a* of the smoothing film 66 is flattened.

Then, an insulating film 67 is formed on the smoothing film 66. Silicon dioxide, which is an example of the inorganic insulating material, is used as the insulating film 67. The insulating film 67 is formed by, for example, PE-CVD (Plasma-Enhanced Chemical Vapor Deposition). The insulating film 67 has a thickness of 1.0 μm or more.

The inorganic insulating material which forms the insulating film 67 is not limited to silicon dioxide. As the inorganic insulating material, it is possible to use, for example, $Al_2O_3$, SiN, ZnO, MgO, $ZrO_2$, $Ta_2O_5$, $Cr_2O_3$, $TiO_2$, $Y_2O_3$, YBCO, mullite ($Al_2O_3.SiO_2$), $SrTiO_3$, $Si_3N_4$, ZrN, AlN, or $Fe_3O_4$.

As the method of forming the insulating film 67, it is possible to use, for example, MBE (Molecular Beam Epitaxy), AP-CVD (Atmospheric-Pressure Chemical Vapor Deposition), ALD (Atomic-Layer Deposition), or application, as well as PE-CVD. In other words, the method of forming the insulating film 67 is not limited, as long as the inorganic insulating material can be deposited on the smoothing film 66 by reacting or condensing the inorganic insulating material including $SiO_2$ on the smoothing film 66 in a vacuum or the atmosphere.

When the insulating film 67 is formed, part of the conductor pattern 30 which is guided to the surface of the substrate structure 41 is masked. Thereby, the insulating film 67 is prevented from being formed on the part of the conductor pattern 30 to which a tape carrier package 31 is connected.

Lastly, a protective film 68 is formed on the insulating film 67. The protective film 68 is formed by, for example, ALD (Atomic-Layer Deposition). The protective film 68 has a thickness of 50 nm or more.

As the method of forming the protective film 68, it is possible to use AP-CVD (Atmospheric-Pressure Chemical Vapor Deposition) or the like, as well as ALD. In other words, the method of forming the protective film 68 is not limited, as long as the inorganic insulating material such as hafnium oxide can be deposited on the insulating film 67 by reacting or condensing the inorganic insulating material on the insulating film 67 in a vacuum or the atmosphere.

In addition, when the protective film 68 is formed, part of the conductor pattern 30 which is guided to the surface of the substrate structure 41 is masked. Thereby, the protective film 68 is prevented from being formed on the part of the conductor pattern 30, to which the tape carrier package 31 is connected.

According to the third embodiment, the copper plating layer 61 which serves as an undercoat of the electrodes 60 has a function of absorbing many depressions and projections 23 generated on the internal surfaces of the long grooves 11, and smoothing the surfaces 60*a* of the electrodes 60. Therefore, the surface 60*a* of each electrode 60 is a flat surface, from which pointed projections that cause pin holes are removed.

In addition, the smoothing film 66 is interposed between the surface 60*a* of each electrode 60 and the insulating film 67. The surface 66*a* of the smoothing film 66, which is apart from each electrode 60, is a flat surface, from which pointed projections that cause pin holes are removed.

Therefore, since the smoothing film 66 further exists on the surface 60*a* of each electrode 60, which has increased flatness, it is possible to more securely prevent generation of pin holes in the insulating film 67 and the protective film 68 which protect the electrodes 60.

As a result, it is possible to maintain electrical insulation of the electrodes 60 from ink by using the electrode protective layer 65 having the three-layer structure, and avoid corrosion of the electrodes 60 and electrical decomposition of ink. Therefore, it is possible to obtain the inkjet head 1 which has a good printing quality and excellent durability, in the same manner as the first embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a substrate which is formed of a piezoelectric material, the substrate including a plurality of grooves that are arranged at intervals;

a nozzle plate which is fixed onto the substrate by an adhesive, the nozzle plate including a plurality of nozzles that are formed by laser processing to communicate with the grooves;

a plurality of electrodes to which a driving voltage that deforms the grooves is applied, the electrodes being formed on respective internal surfaces of the grooves;

a first inorganic film which is superposed on the electrodes, the first inorganic film having a flat surface that is apart from the electrodes;

a second inorganic film which is superposed on the first inorganic film; and a third inorganic film which is superposed on the second inorganic film, the third inorganic film being soaked in ink that is supplied to the grooves.

2. The inkjet head of claim 1, wherein the first inorganic film is formed of an inorganic insulating material which is applied onto the electrodes.

3. The inkjet head of claim 2, wherein each of the electrodes includes a rough surface, and the first inorganic film has a thickness with which the first inorganic film is capable of absorbing many depressions and projections that are generated on the rough surface of each of the electrodes.

4. The inkjet head of claim 3, wherein the first inorganic film includes a flat surface which is apart from the electrodes, and the second inorganic film is superposed on the flat surface of the first inorganic film.

5. The inkjet head of claim 1, wherein the internal surface of each of the grooves is a rough surface.

6. The inkjet head of claim 5, wherein each of the electrodes is formed of a plurality of metal layers which are superposed to cover the internal surfaces of the grooves.

7. The inkjet head of claim 6, wherein each of the electrodes includes a flat surface which is apart from the internal surface of the corresponding groove, and the surface of each of the electrodes is covered with the first inorganic film.

* * * * *